United States Patent [19]

Michelson

[11] 4,248,288

[45] Feb. 3, 1981

[54] FUSION PROCESS FOR FORMING SHELL CORES

[76] Inventor: Anatol Michelson, 3235 Pine Valley Dr., Sarasota, Fla. 33579

[21] Appl. No.: 67,818

[22] Filed: Aug. 20, 1979

[51] Int. Cl.[3] ..... B22C 13/08

[52] U.S. Cl. ..... 164/16; 164/165

[58] Field of Search ..... 164/12, 16, 165, 166, 164/361

[56] References Cited

U.S. PATENT DOCUMENTS 2,797,457 7/1957 Kramer ..... 164/16

FOREIGN PATENT DOCUMENTS 572051 3/1959 Canada ..... 164/165
48-30210 9/1973 Japan ..... 164/16
49-1384 1/1974 Japan ..... 164/165
51-109217 9/1976 Japan ..... 164/165

*Primary Examiner*—Robert D. Baldwin

[57] ABSTRACT

A process for cold forming of a shell core foundry product comprising the introduction of a first supply of binder coated granular material, hardening this first supply into the shape of separated and movably disposed core portions and subsequently introducing a second supply of binder coated granular material into spaced apart sections of the core portions and subsequently hardening this second supply in a manner which will cause fusion between the already formed core portions and the newly introduced supply of granular material in a manner which will join the previously formed core portion and thereby define an integral one piece shell core with a substantially continuous outer surface eliminating the existence of an investment hole in the formed shell core.

7 Claims, 11 Drawing Figures

FUSION PROCESS FOR FORMING SHELL CORES

BACKGROUND OF THE INVENTION

1. Field of the Invention

This invention relates to a process of cold forming a shell core in a manner utilizing binder coated granular material hardened through the introduction of catalyst gas wherein the shell core is originally formed by the joining of hollow preformed core portions and wherein such joining occurs through the performance of a fusion process so as to define a one piece integral shell core eliminating the need or usage of investment hole in the outer surface or wall portions of the shell core.

2. Description of the Prior Art

In the formation of a foundry product, and in particular hollow foundry products such as shell cores, conventional methods have generally involved the application of heat in the hardening of the sand or granular material forming the shell core. The use of such heat obviously has disadvantages due to the increased cost of fuel or energy to create such heat. Such prior art process also have inherent problem of taking a long curing times resulting in greater overhall production time in producing the desired shell cores.

In recent years methods have been developed utilizing a cold forming process whereby the requirement of large amounts of heat and therefore energy is eliminated. In such processes a catalyst gas is exposed to granular material or sand having a binder coating thereon. Such exposure results in reaction of the binder and certain resins contained therein to cause a hardening of the granular material into a predetermined configuration, as desired.

In the formation of hollow or shell cores prior art process normally involve the inclusion in the outer wall of the formed cores of an investment hole. This investment hole was required to remove the unhardened sand or granular material from the interior of the core. As can readily be appreciated the larger the intended core the greater difficulty was encountered in handling the core due to the increased weight, etc. Also more material was required in forming such prior art core products because of the need to fill the entire interior of the core, harden the exterior "shell" and then remove the unhardened granular material from the interior of the formed core.

Accordingly, there is an obvious need in the foundry industry for the formation of a shell core product utilizing a cold forming process or technique and eliminating the problems associated with removal of the unhardened portions of the interior through an investment hole, etc.

Such a process would have the advantages of shorter production time, use of less material, ease of handling because of lighter weight of the formed product and overall increase in the quality of the product due to the elimination of any investment hole structure.

SUMMARY OF THE INVENTION

The present invention relates to a fusion process for cold forming a shell core utilizing a binder coated granular material such as sand designed to be hardened upon exposure to a catalyst gas. The binder used on the granular material of the present invention includes a predetermined resin which will not only cause hardening and bonding of the specific granular particles or sand upon exposure to such catalyst gas but also after hardening will fuse to a second quantity of similarly coated granular material upon a second introduction of catalyst gas, under pressure.

More specifically, a first supply of binder coated sand or granular material is introduced into a core cavity defined by an interior mandrel and exterior core box sections. The mandrel is movable into and out of formed interior of the core box sections and the sections themselves are movable relative to the mandrel to be closed thereabout. The space existing between the outer surface of the enclosed mandrel and the inner surface of the surrounding core box sections defines the aforementioned core cavity into which a first supply of binder coated granular material or sand is introduced.

Subsequent to such introduction catalyst gas is exposed thereto to cause hardening of such first supply of granular material.

The mandrel, due to its movable disposition is thereby removed from the interior of the core box sections after separation from the core portions formed from the first supply of binder coated granular material after the introduction of the catalyst gas.

The core box sections are then disposed into engagement with one another to a point where the core portions associated with each core box sections are brought into a predetermined spaced apart distance from one another.

Due to the particular dimensions and configuration of predetermined portions of the mandrel relative to correspondingly positioned and predetermined portions of the core box sections, a void is formed and defined between predetermined spaced apart portions of the core portions. Such void is disposed on the interior of the core box sections and is accessable for the introduction of a second supply of binder coated granular material so as to affectively fill such void. After such filling the core box sections and the previously formed core portions are repositioned for displacement into a closer spaced apart distance then originally existed prior to the introduction of the second supply of sand into the void. This repositioning serves to compact the newly introduced sand or granular material and force such sand into the void into intimate contact with the formed core portions defining the boundaries of the void. After such repositioning and compaction a second supply if catalyst gas is introduced to the newly introduced granular material.

This new introduction of catalyst gas serves to allows reaction of the binder for the purpose of hardening the newly introduced granular material and for the purpose of fusing the newly introduced granular material to the previously or initially hardened core portions. This fusion causes an integral joining or connecting of the two core portions formed in the two core box sections and provides an integral, one piece core shall having an hollow interior and substantially consistent uninterruptive wall absent the existence of any investment hole. It it obvious that such investment hole is not required since there is no unhardened granular material on the interior of the formed shell core. This is obviously due to the initial placement of the mandrel on the interior of the core box sections in a manner which serves to define the initial core cavity as set forth above.

An important feature of the subject invention is the dimensioning and configuration of the mandrel relative to the core box section to allow the positioning of the core box section into engagement with one another so as to form the void. This relative structuring of the mandrel and the core box sections thereby allows the positioning of the initially formed core portions into a closer relationship to one another thereby allowing compacting of the granular material introduced into the void.

The particular qualities of a predetermined resin existing in the binder coated about the granular material, as pointed out above allows fusion between the initially hardened core portions and the latter introduced granular material positioned in the void after the introduction of the catalyst gas thereto.

The invention accordingly comprises the features of construction of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
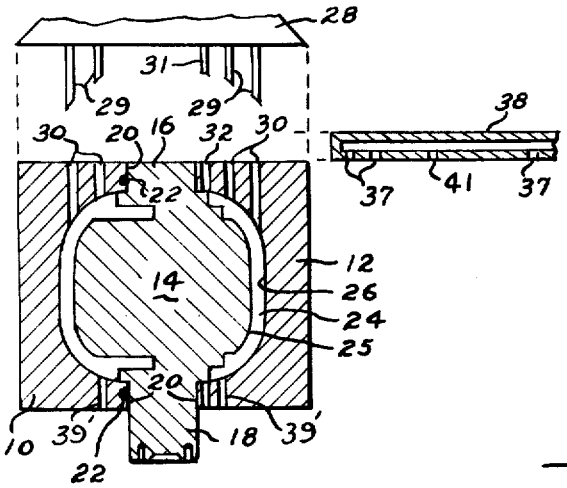
FIGS. 1 through 4 are cross sectional views showing the relative structure of the core box sections and mandrel during formation of the initial core portions upon the introduction of catalyst gas thereto.

As shown in FIG. 1 the process of the subject invention comprises the utilization of the core box defined by at least two core box sections 10 and 12 movable relative to one another and to a centrally disposable mandrel 14. The mandrel specifically includes a head portion 16 and a stem portion 18. Accordingly the respective core box sections 10 and 12 include mouth portions 20 and 21 which are disposed to close about in sealing relation to the head and stem portion 16 and 18 respectively of the mandrel 14. Sealing gaskets or like elements 22 are disposed to maintain sealing engagement between the core box sections 10 and 12 and the mandrel 14 when in closed relation thereabouts. As shown in FIGS. 1 through 4 a core cavity 24 is thereby formed between the outer surface 25 of the mandrel and the inner surface 26 of the respective core box sections wherein the formation of such cavity at least in part defines the configuration of the initial core portions 30 and 32 being formed.

Again with reference to FIG. 1 the binder coated granular material or sand is introduced into the core cavity 24 hrough the placement of a blow head 28 relative to the core box section. The actual granular material is introduced into cavity 24 by a plurality of conduits 29 specifically disposed for alignment with receiving channels 30 formed in each of the core box sections 10 and 12 and communicating with the core cavity 24. At least one additional conduit 31 is secured to the blow head but, upon the initial introduction of the first supply of granular material to the cavity 24, the conduit 31 remains inactive or is displaced out of operative relation relative to the core box sections 10 or 12 as will be explained in greater detail hereinafter. Similarly a substantially aligned and/or correspondingly disposed conduit 32 is formed in the core box section 12 but in not brought into working operation upon the initial introduction of the first supply of granular material to the core cavity 24.

Figure 2:
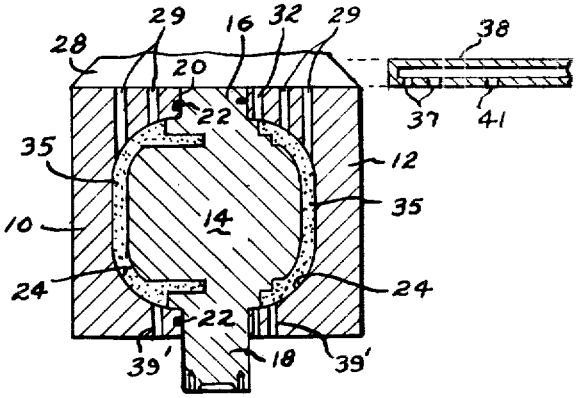
Figure 3:
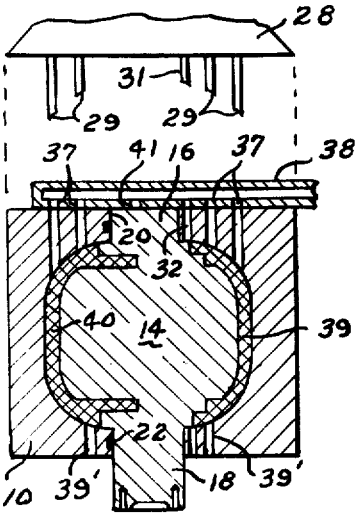

With reference to FIGS. 2 and 3 the blow head is moved into mating engagement with the core box sections 10 and 12 and the conduits 29 are disposed within this respective aligned channels 30 for the introduction of the first supply of granular material, in unhardened condition, represented as 35 (FIG. 2) into the core cavity 24.

Figure 4:
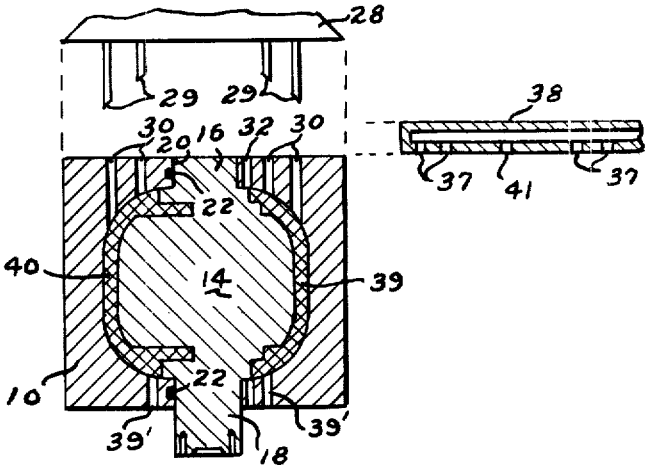

With regard to FIG. 3 the blow head 28 is removed from the core box sections 10 and 12 after such introduction and a gas manifold 38 is disposed in communicating relation the core box sections 10 and 12. More specifically the gas manifold serves to deliver the catalyst gas to the interior of the core cavity 24 for exposure to the unhardened granular material 35. The manifold includes a plurality of apertures 37 specifically structured for alignment with the conduits 29 so that the catalyst gas may pass through the conduits, into direct exposure with the granular material 35. Due to the porescity of the granular material and the specific structure of the core box sections 10 and 12 the catalyst gas is allowed to pass completely through the granular material and exit through the exhaust channels 39 to insure complete contact and exposure of the catalyst gas to the granular material. This exposure of course causes hardening of the granular material due to a reaction of the binder thereon. This in turn causes the initial formation of the core portions 39 and 40 into the configuration corresponding to that of the core cavity 24. It should be noted that the gas mandrel 38 further includes a gas introduction means in the form of at least one additional entrance aperture 31 which, as will be explained in greater detail hereinafter, is disposed for alignment with the entrance channel 32 formed in core box section 12. With reference to FIG. 4 the core portions 39 and 40 are thereby caused to harden after the introduction of the catalyst gas and passage therefrom from the core box sections 10 and 12 through the exhaust conduits 39.

Figure 5:
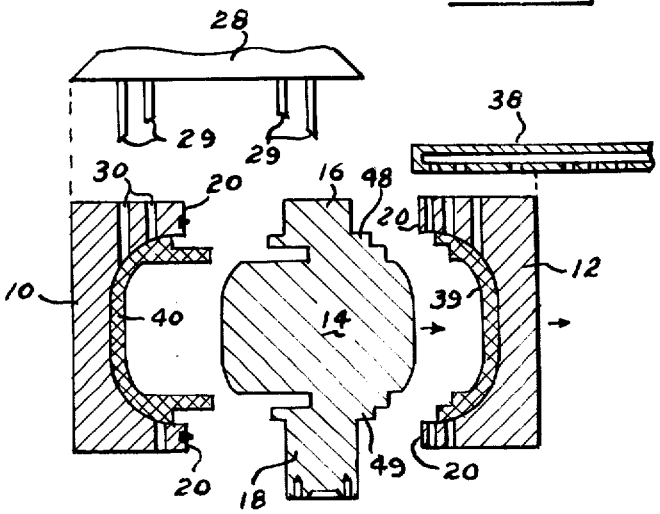
FIG. 5 shows a sectional view of the removal of the mandrel from the interior of the core box sections after separation thereof.

As shown in FIG. 5 after hardening of the core portions 39 and 40 the mandrel 14 is removed therefrom. This is accomplished by the separation of core box sections 10 and 12 and the opening of the interior thereof so as to separate the core portions 39 and 40 from the mandrel.

Figure 6:
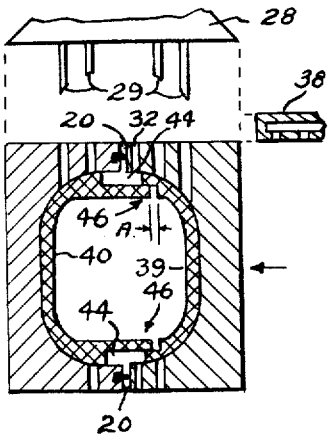
FIG. 6 shows a disposition of the core box sections into a first spaced apart distance so as to define the void between the core portions.

As shown in FIG. 6 the mandrel is removed entirely from between the core box sections 10 and 12 and these sections are thereby then brought into sealing engagement with one another so as to position the core portions 39 and 40 a predetermined spaced apart distance from one another represented by the distance A. By virtue of this disposition a void 44 is formed in communicating relation with the entrance conduit channel 32. This void is defined by various parts of the core portions 39 and 40 brought into engagement with one another generally represented as at 46.

In the positioning of the formed core portions 39 and 40 specifically with the elements interconnecting to one another as at 46 it is important to note that the mandrel is specifically configured to include end-forming portions 48 and 49 disposed adjacent and /or contiguous to the head and stem portions 16 and 18 of the mandrel respectively. In the formation of the mandrel in this manner the transverse dimension of both the head and stem portions 16 and 18 will always be less than the transverse dimension of the end-forming portions 48 and 49 respectively, and into sealing engagement with one another as at 20 will always provide the existence of a void 44.

Figure 7:
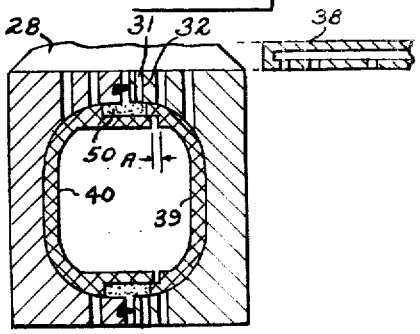
FIGS. 7 and 8 are sectional views showing introduction of granular material to the void and compaction of the granular material within the void upon movement of the core box sections a closer spaced apart distance to one another.
Figure 8:
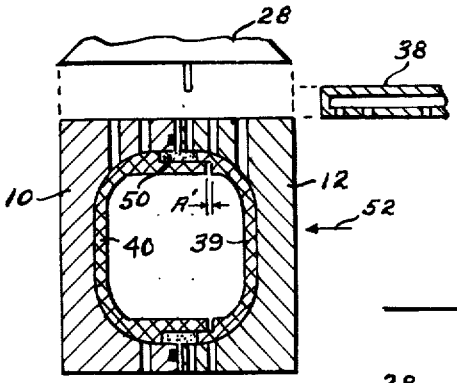

With regard to FIG. 7 this void 44 is formed with a second supply of binder coated granular material 50 through the placement and activation of the conduit 31 into the receiving channel 32. At this point the core portions 39 and 40 are still separated a predetermined distance A.

After the introduction of the second supply of granular material 50 the blow head 28 is removed therefrom for the withdrawal of supply conduit 31. After such withdrawal the core box sections 10 and 12 are repositioned relative to one another as indicated by directional arrow 52 for the purpose of intern repositioning core portions 39 and 40 a given spaced apart distance A' which is less than the original spaced apart distance A. The movement of the core portions 39 and 40 towards one another to arrive at the spaced apart distance A' serves to compact the second supply of granular material 50 disposed within the void 44 since the dimensions of the void are of course made smaller due to the shortening of the distance A'.

Figure 9:
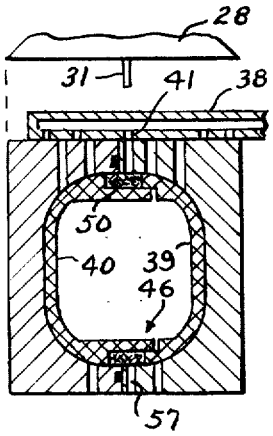
FIGS. 9 and 10 show hardening of the compacted granular material within the void and fusion of such hardened granular material to the remaining, initially formed core portions upon the introduction of catalyst gas.
Figure 10:
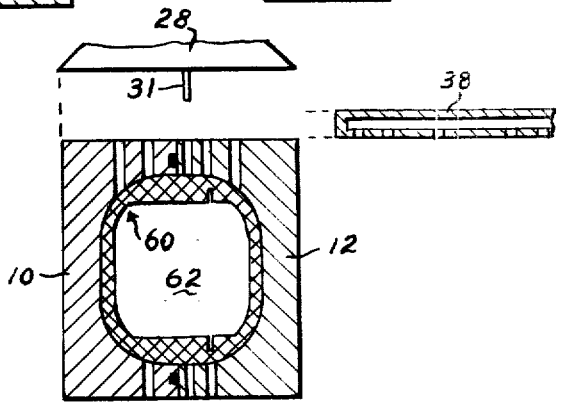

With reference to FIGS. 9 and 10 the gas manifold 38 is disposed into registry with the granular material within the void for the purpose of directing catalyst gas through the aperture 41 and into the entrance channel 32 disposed in communicating relation with the granular material within the void 44. This exposure of course serves to hardened the granular material 50 as it passes completely therethrough and exits from the secondary exhaust channel 57.

Due to the special properties existing in the resin which is part of the binder coated about the granular material or sand the prior compaction of the granular material and the bringing it into its intimate contact in engagement with the surrounding portions of initially formed cored portions 39 and 40 as at 46 causes a thorough fusion between the hardened granular material particles 50 and the parts of the individual core portions 39 and 40 defining the boundries of the void 44. Therefore an integral, one piece shell core 60 having a hollow interior 62 is formed between the core box sections 10 and 12 after fusion takes place between the granular material particles 50 and the preformed or initially formed core portions 39 and 40. The resulting product is a hollow, shell core 62 which eliminates the structural necessity for the inclusion of an investment hole for removal of any unhardened granular material from the interior thereof.

Figure 11:
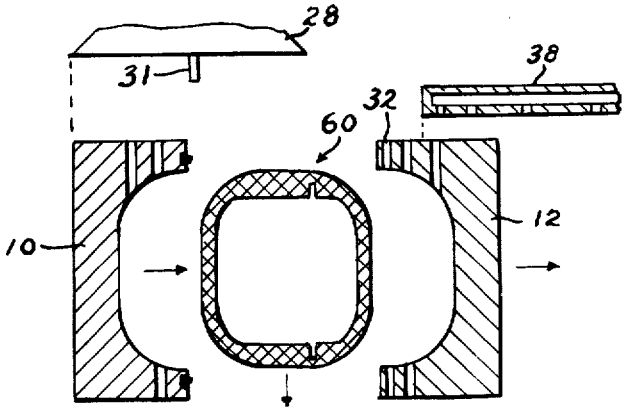
FIG. 11 is a sectional view showing the removal and/or displacement of the formed shell core from the core box sections.

With regard to FIG. 11, the shell core 60 can thereafter be removed from between the core box sections 10 and 12 upon separation thereof and what may be considered a conventional fashion.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A process for forming a foundry shell core product without the application of heat thereto, said process comprising:

(a) forming a mandrel into predetermined configuration to include end-forming portions disposed adjacent head and stem portions thereof and each end-forming portion having a greater transverse dimension than said head and stem portions, (b) inserting said mandrel of predetermined configuration in operative disposition between core box sections, (c) closing said core box sections in surrounding relation about said head and stem positions of said mandrel, (d) introducing a first supply of binder coated granular material into a core cavity defined between said core box sections and the external surface of said mandrel, (e) passing a first supply of catalyst gas through said first supply of granular material causing hardening thereof and the formation of correspondingly configured core portions, (f) separating said core box sections with formed core portions therein and removing said mandrel therefrom, (g) repositioning said core box sections with core portions therein into working position a predetermined spaced apart distance from one another, (h) introducing a second supply of binder coated granular material in spaced apart end portions of said core portions and in engagement with both said core portions, (i) moving said core portions toward one another to a closer spaced apart distance thereby compacting said second supply of binder coated granular material into firm engagement with both said core portions, and (j) introducing a second supply of catalyst gas into said second supply of granular material causing hardening thereof and fusion thereof with said first supply of granular material thereby joining said core portions and forming an integral one piece shell core.

2. A process as in claim 1 comprising shaping the outer surface of said mandrel and the correspondingly positioned intersurface of said core box sections into a predetermined configuration, and disposing said respective inner and outer surfaces in spaced relation to one another to substantially define a core cavity having a configuration corresponding to that of the shell core being formed.

3. A process as in claim 1 comprising disposing each one of said end-forming portions contiguous one of said head and stem portions and facing the interior of said core box sections, and closing said core box sections in spaced apart distance from one another with the distance defined by the transverse dimension of said stem and head portions when said core box sections are closed about said mandrel.

4. A process as in claim 3 comprising forming said end-forming portions having a predetermined transverse dimension and further configuring said mandrel such that the dimension is greater than the dimension of the stem and head portions, thereby defining a void between said spaced apart end portions of said core portions, upon repositioning of said core portions subsequent to removal of said mandrel from therebetween.

5. A process as in claim 4 wherein said void is substantially filled by said introduction of said second supply of binder coated granular material thereby bringing said granular material into intimate engagement with surrounding portions of said void.

6. A process as in claim 5 wherein said core box sections and said formed core portion are moved into closer relation to one another thereby decreasing the dimension of said void and compacting the granular material therein and forming said granular material into intimate contact with core portions defining the boundries of said void.

7. A process as in claim 6 wherein the interior of said core box sections define part of said void whereby an integral portion of the outer surface of the resulting shell mold upon hardening of said second supply of granular material is continuously formed without an investment hole formed therein.

* * * * *